United States Patent [19]

Nation

[11] 4,154,050

[45] May 15, 1979

[54] FAIL-SAFE CABLE AND EFFECT OF NON-FRANGIBLE WIRE IN CABLE STRUCTURES

[76] Inventor: Milton A. Nation, 905 Moraga Dr., Los Angeles, Calif. 90049

[21] Appl. No.: 757,551

[22] Filed: Jan. 5, 1977

[51] Int. Cl.[2] ..... D07B 5/00

[52] U.S. Cl. ..... 57/200; 75/175.5; 148/11.5 F

[58] Field of Search ..... 57/139, 145, 147, 148, 57/166; 148/11.5 F, 12.7; 75/151, 175.5; 72/200, 365, 700; 29/423, 424

[56] References Cited

U.S. PATENT DOCUMENTS

| | | | |
|---|---|---|---|
| 3,194,693 | 7/1965 | Soltis | 148/11.5 F X |
| 3,511,622 | 5/1970 | Nation | 57/166 X |
| 3,511,719 | 5/1970 | Nation | 148/11.5 F |
| 3,527,044 | 9/1970 | Nation | 148/11.5 F X |
| 3,532,559 | 10/1970 | Gullotti et al. | 148/11.5 F |
| 3,575,736 | 4/1971 | Fitzpatrick et al. | 148/11.5 F |
| 3,584,368 | 6/1971 | Sargent | 148/11.5 F X |
| 3,686,041 | 8/1972 | Lee | 148/11.5 R |
| 4,010,046 | 3/1977 | Setzer | 148/11.5 A |
| 4,067,734 | 1/1978 | Curtis | 75/175.5 |

*Primary Examiner*—Donald Watkins

[57] ABSTRACT

A synthesis of four (4) factors is applied, through a test approach, to eliminate wire fractures, and fractures and overstressing of other cable components. This approach shows this "crucial flaw" is prevented from occurring amidst other flaws within the "flaw state" of the complex structure of work performing cable. These other flaws prove to be minor during the cable's service life.

Non-frangible, ductile aluminum (al) and titanium (ti) wire are used in the cable assembly wherein their high dynamic properties and other attributes prevent wire fractures, and neutralize or reduce wire wear, depending upon load level, to change and improve the cable's "flaw state" so that a "fail-safe" cable may be designed to provide a protracted service life.

Steel and copper wire fail to qualify for "fail-safe" cable constructions due to their low dynamic properties and other flaws in the cable structure.

10 Claims, 5 Drawing Figures

DIAGRAMMATIC COMPARISON

Figure 1A:
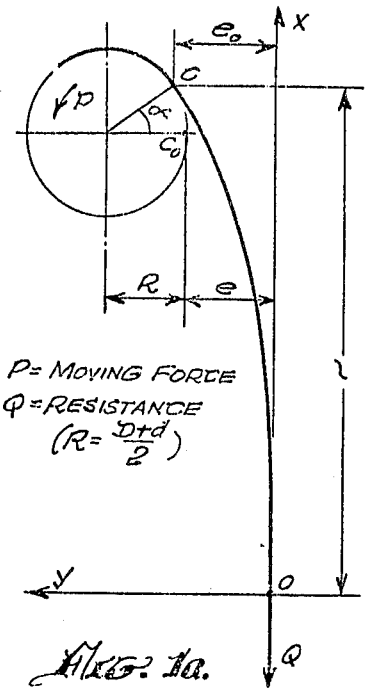

FIG. 3.
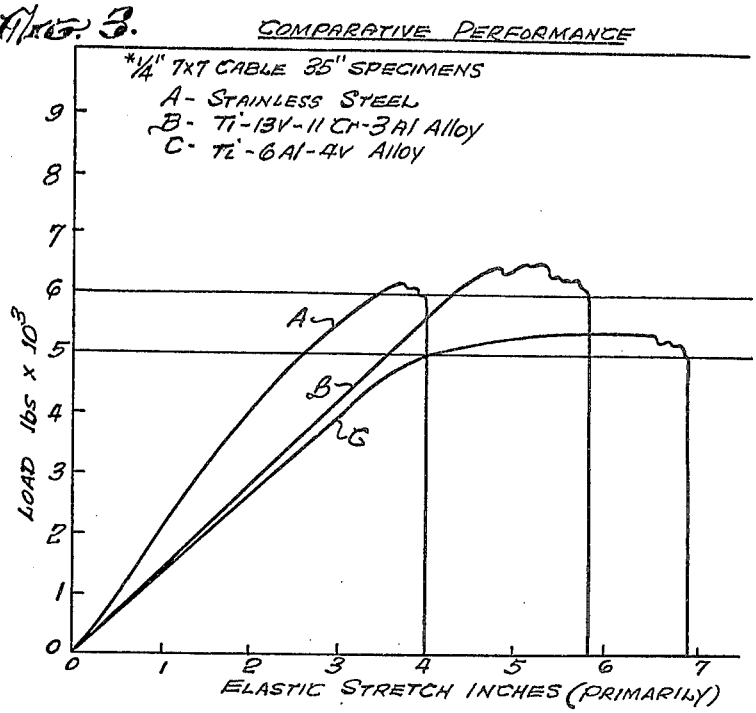
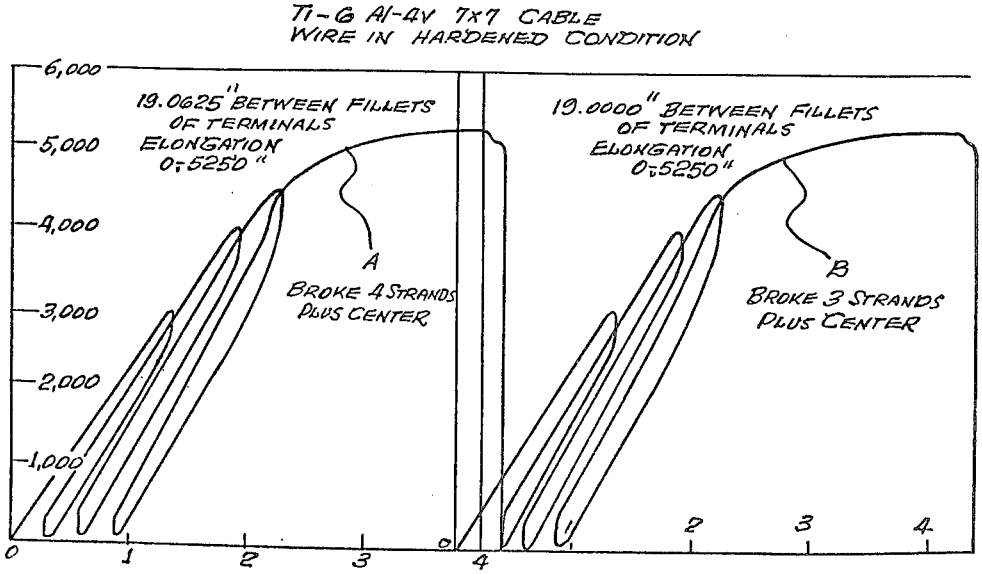
FIG. 4.
LOAD DEFLECTION - TWO (2) 1/4" x 7x7, Ti 6Al-4V SPECIMENS
LOAD INCREMENTS 100#

FAIL-SAFE CABLE AND EFFECT OF NON-FRANGIBLE WIRE IN CABLE STRUCTURES

BACKGROUND OF THE INVENTION

This invention relates to cable wire fractures and fracture-tough wire produced from non-frangible aluminum (al) and titanium (ti) base alloys that transition from brittle to ductile metallurgical condition in processing. More specifically it relates to change in cable flaw state by eliminating wire fractures so as to increase reliability and service. Two (2) additional patent applications are submitted herewith, (1) Cable Stress and Fatigue Control Ser. No. 757,300, and (2) Deep Well Handling and Logging System, Ser. No. 757,552. These patent applications are related and copending.

It is found that alloys of al and ti have many attributes for use in cable tension members but two (2) attributes are common to selected alloys of each, and are crucial to this invention:

(1) High dynamic properties in the base metals including abnormally high spring which are essential to effective energy absorption, storage and dissipation in tension systems; and (2) Selected alloys are processed through brittle-ductile transition so as to embody high energy (in ft.-lbs) and fracture extension resistance, and then are non-frangible in cable structures.

While selected steel alloys may likewise be non-frangible in test specimens they fail to qualify because of low dynamic properties and wire fractures, crucial to serviceability in steel work performing cable, and in the old manners, are extremely limiting in the use of effective design criteria for cable constructions.

In analyzing the significance of fractures in "work performing" cable, it should be recognized that the behavior of all structures is derived from both the type of mechanical force system and the metallurgical type of metal. The mechanical aspects involve the relative compliance characteristics which determine the stored energy available for fracture propagation (hereinafter called mechanical); the metallurgical aspects involve relative ductility characteristics which determine the energy absorption and dissipation capacity to fracture initiation and extension (hereinafter called metallurgical). These two (2) qualities of any structure operate in concert to determine how the structure will respond to loading in the presence of flaws, as has been commonly seen in the wire fractures and short service of steel cable. Essentially, the flaw state design of tension systems is the basis for assessment of these interactions as in any structure. In this context cable structures are complex, thus placing a premium on non-frangible, ductile wire to overcome structural flaws.

Characteristics cable stresses when performing work are:

Simple bend stresses are $\sigma b = \delta / D \times Ec$ with other bend stresses induced depending upon cable constructions Surface contact stresses are $\sigma c = K\sqrt{P}$ Impact stresses are $\sigma i = Vo\sqrt{Ec \times \rho c}$ Internal stresses are local but may be generally severe as functions of relative mass density ($\rho c$) and elasticity (Ec).

These stresses are of course induced and superimposed upon cable tension. It may now be seen that frangible wire with low dynamic properties will not provide fracture-safe cable structures. Once wire fractures begin, as characteristic of structures having flaws, they continue and most often accelerate, wherein safety factors grow marginal until reaching a catastrophically low strength condition. In view of the complex construction of both axially symmetric and contrahelically wrapped electrochemical cable for sustaining primary loads and the characteristic severity of these dynamic stresses in performing work, three cable structures must be considered, (a) mechanically flawed (b) very sensitive to both mechanical and physical properties, and (c) metallurgical condition.

SUMMARY OF INVENTION

This invention embodies four (4) factors which are combined and synthesized to result in fracture-tough, non-frangible wire and fracture safe cable. The first two (2) factors, mechanical and metallurgical have been outlined above. Two other crucial factors are:

Third factor — high dynamic properties and high hard spring in wire, such as defined (also see FIGS. 1 and 2) above for al and ti, so that dynamic stresses superimposed on tension are moderated under passive control whereby the physical properties of wear, fatigue and abrasion do not result in flaws.

Fourth factor — design criteria derived from and synthesized with the mechanical and metallurgical factors (above) avoid structural flaws so that fail-safe cable may be constructed. These factors combined with lay angles, wire sizes and cable constructions, by physical law absorb, store and dissipate energy through stress-vibration and counterbalancing wherein physical conditions noted above progress at low grade rates, and no single dynamic stress, or stress combination, may cause overstressing or fracturing of strands or cable.

This synthesis of factors has been reduced to practice for two (2) ti base alloys, one alloy being non-frangible, Ti-6Al-4V, and one frangible alloy, Ti-13V-11Cr-3al. The former proved to be fracture and fail-safe during protracted cycling. Various flaws developed in shorter cycling periods in other type specimens especially including corrosion resistant steel and improved plow steel.

Objects of the invention are:

First — Synthesize four (4) cable factors (1—relative mechanical force for compliance, 2—relative metallurgical characteristics for ductility, 3—high dynamic properties, and 4—special design criteria) through a test approach to produce fracture-tough and fail-safe cable from al and ti alloys.

Second — Eliminate "crucial" wire fractions from work performing cable during service life.

Third — Provide a means to produce and qualify non-frangible, ductile wires from the range of al and ti base alloys so that these wires serve as models for flaw behavior in the complex cable structure.

Finally — Provide a correlated design and test approach to demonstrate "fail-safe" cable design that eliminates "crucial" wire fracture flaws while further minimizing other flaws of the cable "flaw state."

Three physical factors operate in concert to sustain the primary load and dynamic stresses:

1. Non frangible wires, having been processed through a brittle-ductile transition, then are assembled into work performing cable having a changed flaw state
2. Compliant and ductile wires resist fracture and extension, and are permanently lubricated 3. In service the wires have high resistance to wear, including abrasion, and strain-hardening, an uncommon set of attributes.

The high dynamic properties and soft cable spring for dissipating energy, then moderate the attributes outlined above, (1) relative metallurgical for storing energy, and (2) relative mechanical for absorbing it, wherein each factor has been effectively optimized and the unworkable high tensile strength concept has been discarded so that work may be performed on a fail-safe, protracted basis.

Selected alloys of two base metals al and ti, both non-ferrous qualify in the two (2) characteristic factors as outlined above, (1) metallurgical for storing energy, and (2) mechanical for absorbing energy. Moreover they each qualify in the latter characteristic for dissipating energy as well, having a high wire hard spring constant. Their alloys each have low density and high elasticity for effective high dynamic property ranges:

Al-density 0.08–0.10 lbs per cu in - E. modulus $16\times10^6$ p.s.i.

Ti-density 0.15–0.175 lbs per cu in - E modulus $8\text{–}9\times10^6$ p.s.i. Gap between yield and ultimate strengths, Al 1–15 percent and Ti 2–10 percent. Although a few steel alloys are non-frangible, their dynamic properties are much too low.

Figure 1B:
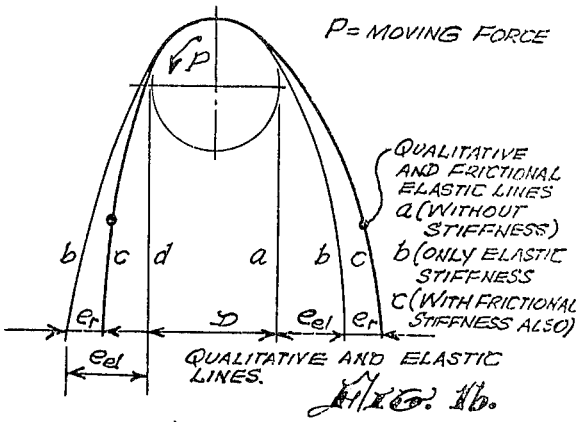
Figure 1C:
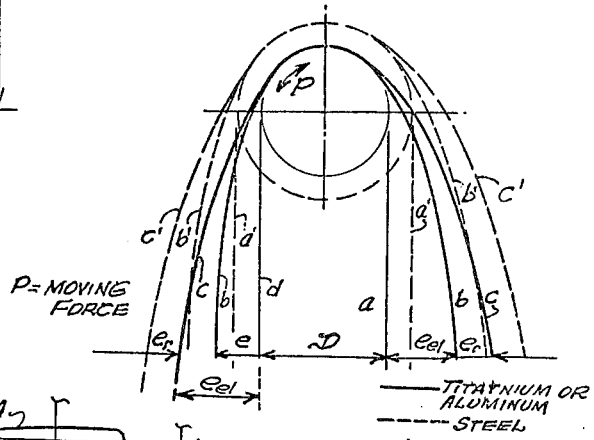

FIG. 1*a* is a classical diagram wherein P is the moving force (mechanical) and Q represents qualitative resistance ($R=D+d/2$) for either al or ti although al resistance is markedly lower than ti. FIG. 1*b* further represents qualitative elastic and frictional resistance in cable, again for either al or ti. FIG. 1*c* then shows graphic comparison between steel and either al or ti wherein steel requires a larger drum or sheave and induces greater bend stress even though the D/d ratio for ti and al are smaller since one bend stress function is compliance (steel elastic modulus — $28.5\times10^6$ p.s.i.) in concert with the moving force.

Figure 2:
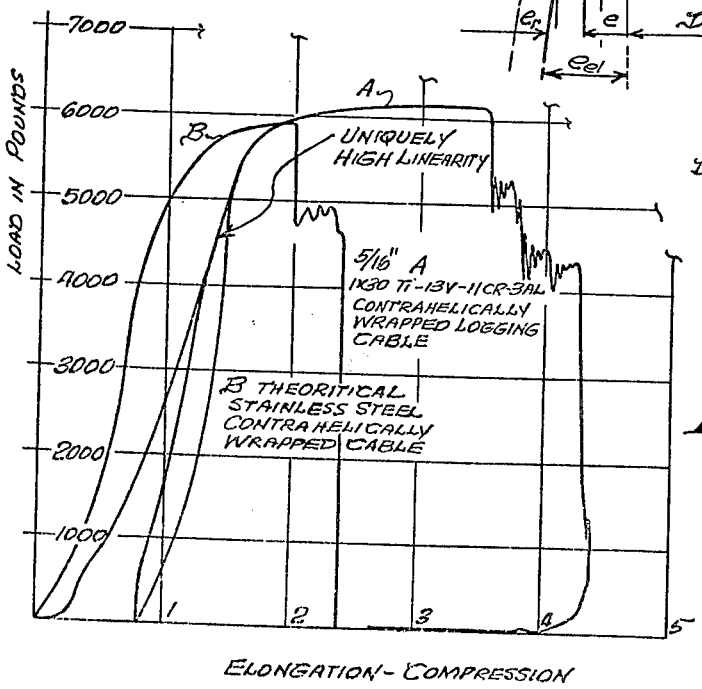

FIG. 2 shows a complete, actual load deflection diagram for a 5/16" ti well logging cable, and graphically defining the long, linear elastic and constructional stretch of this cable wherein an estimate of the same stainless steel cable is also compared. It is of interest to note in the steel cable the wide gap between yield and ultimate strengths, non linear deflection and the much lower elastic and constructional stretch shown horizontally (abscissa). Non linear deflection may denote wire overstressing or fractures whereas linear deflection and narrow gap shows no over-stressing or wire fractures.

FIGS. 3 and 4 show load deflection diagrams for various materials.

It should be convenient to define a range of terms associated with fracture-toughness as applied to wire and cable, and explain their usefulness in this invention.

Fracture-toughness is simply defined as a relationship between fracture-resistance and strength. In the case of wire it may be determined by tensile and torsional strength parameters. Fracture-toughness is normally inversely proportional to yield strength.

Fracture-toughness of metal alloys is determined by standard tests:

Charpy-V test measures values of fracture initiation, propagation and arrest

KI is a stress intensity factor denoting the opening mode of crack extension, wherein:

KIc denotes slow-load (static) plane strain fracture-toughness (K.S.I. in)

KId denotes dynamic load plane strain fracture-toughness (K.S.I. in.)

KQ denotes invalid measurements characterizing non-frangible metals.

Fracture-mechanics of cable recognizes fracture-toughness is controlled by mechanical constraint and flaw severity factors, wherein al and ti cable may be effectively compared with steel cable as shown in the load deflection diagram composite of FIG. 3.

Ductility is an intrinsic metallurgical characteristic of brittle-ductile transition wherein mechanical parameters serve to describe the metal response to specific stress states, such as percentage of wire elongation. Ductility transition temperature range can only be determined by dynamic fracture tests.

Dynamic tear test represents an advanced engineering test which provides accurate indexing of transition in ft.-lb terms as to how fracture mechanics apply in plane stress specimen configuration that provides sufficient fracture extension to allow plane stress fracture-toughness to the degree characteristic of the alloy tested.

Frangible as applied to metal alloys means breakable and brittle, and in wire form, these alloys are susceptible to fracture in cable dynamics states.

Non-frangible is the opposite of frangible, specifically having high ductility, fracture-toughness, and fracture extension resistance.

Fracture extension resistance is a metallurgical condition and index of an alloy at a constant load level determined by test; data banks may be available to show normalized curves for categories of alloys that graphically show load values vs resistance wherein all non-frangible alloys would be represented on a steep rising curve.

Fail-safe design of cable embodies first the use of ductile, non-frangible wire assembled into cable which has been designed and tested to eliminate fractures, over-stressed components and other flaws when performing work, in this invention, by other means than high tensile strength and safety factors.

"Flaw-state" of cable if always a matter of semi-qualitative description, and therefore must be described in "rough-cuts" such as "minor" or "major" flaws, or "fracture-prone."

Protracted is specially defined to mean a much longer service period than normal for identical steel cable, the common standard perhaps not less than four (4) times, and even much greater in many applications.

The novel factors considered characteristic of the elimination of wire fractures and developing fracture-toughness of this invention are set forth with particularity in the appended claims. The invention itself however, both as to organization and method of operation as well as additional objects and advantages will be best understood from the following description, starting with a synthesis of the four (4) principle factors herewith.

A synthesis of four (4) factors are essential and is made to prevent wire fractures and overstressing in work performing cable in this invention. In effect not only the two (2) previously outlined, mechanical and metallurgical, are related and interact, but also the following two (2) factors interact as further outlined:

(1) Dynamic stresses are controlled within low regime loading according to the data presented above because of the high dynamic properties including high hard spring of selected alloys of al and ti wire. These stresses of course are a part of mechanical force in cable structures but are moderated markedly, compared to steel, so that passive energy control embodies not only energy absorption and storage but also distinct cable soft spring for dissipating energy. On this basis less energy is absorbed and less stored while it is dissipated effectively to improve the cable loading characteristic, to the point that tensile stress of the primary load is equalized in components rapidly in dynamic states by design, compliance, stress vibration and counterbalancing, these factors being dynamic interaction characteristics.

(2) Design criteria become far more effective in the cable structure wherein each criterion has far more design scope toward the elimination or change of minor flaws, and for that matter, the control of crucial wire fractures. The criteria may be confidently used, for example, to reduce the number of wires, (or the alternative, increase them) to reduce internal stresses, increase compliance in bending cable and counterbalancing; apply spring to reduce and dampen torque; and shorten lay lengths to increase counterbalancing and flexibility. These options may be exercised within limits to prevent wire fractures, or as trade-offs to improve performance, efficiency and service wherein the major flaw, wire fracture is avoided. These criteria may be used, of course, to counteract minor flaws such as wear, fatigue, and to optimize load and dynamic stresses.

Wire fractures in the assembly complex of the cable structure, represent catastrophic results of this essential structural component that, in fact are crucial to work performance and cable condition. Once wire fractures start to occur, they normally accelerate progressively in service wherein the cable flaw-state becomes a critical problem in work operations; while wire wear and fatigue may be associated, the dominant flaw is wire fracturing.

Eliminating wire fractures, as well as overstressing and fracturing larger components and even complete cable-cross sections, is the principle object since other flaws are relatively minor. While it is understood that wire may always be fractured by overloading and kinking as a part of the fracture-mechanics, this requires specially induced plastic flow to initiate the fracture process, which is not normally a part of cable flaw state. It is also understood that fracture-toughness, as a dual mechanical and metallurgical characteristic, is inherently a part of the fracture process and the flaw state of cable components.

The two interrelated factors, outlined above, (1) the mechanical force system, and (2) the metallurgy of the wire, operate in concert in the behavior of cable structures, wherein by analysis, mechanical and dynamic relations involve compliance characteristics for determining stored energy available for fracture propagation, whereas the metallurgical and dynamic aspects involve the relative ductility characteristics which determine the energy absorption capacity (resistance) to fracture initiation and extension. These two (2) factors respond to loading in the presence of flaws, so that a "fail-safe" design is made by assessing the loading interactions.

A basic requirement of this invention is that test specimens must model the behavior of structure that contain flaws. It follows: (1) initial testing is performed of suitable metal model specimens to test for (a) frangibility and their energy level (ft.-lbs) in a drop tear test to resist fracture extension, and (b) brittle-ductile transition at the appropriate thermal level, and (2) non-frangible cable specimen testing under load is finally performed to determine design suitability in the presence of minor flaws, the major flaw of frangibility (fracture) having been removed.

Steel wire often fractures in cables, most often in materials handling systems while performing work due to severe bend stresses, and entire cables either fracture, or core wires fracture due to impact stresses, resulting from starting and stopping and other overload impacts. These two stresses combine with other characteristic stresses including wire pressure from tension and internal stresses, to induce extremely high tension peaks because of low dynamic properties.

The core strand normally fails first since this strand has less constructional stretch than outer strands and greater wire pressure is induced into the core strand, compared to the outers. Unfortunately, a weakened or overstressed core strand remains unknown, it being covered and invisible wherein cables, or their components, are then more susceptible to catastrophic failure. FIG. 4 shows two (2) load deflection tests of $\frac{1}{4}''$ Ti-6Al-4V cable specimens that produced essentially identical load result responses, without evidencing flaws until reaching a plastic state. Resulting fracture mechanics were also identical but neither one fractured catastrophically. Single wires did not fracture until well into the curvalinear part of the load diagram.

Single fractures of outer wires are especially serious to contrahelically armored cable. This cable so damaged becomes very difficult to handle in long lengths, its serviceability becoming effectively reduced. Repairs are either impractical or are rarely satisfactory.

These armor fractures are normally due to severe bend stresses in steel wire in bending regions when paying out or collecting cable on drums or running over sheaves. Bend stresses ($\sigma b$) so induced into this wire are normally severe due to the high elastic modulus, $29\times10^6$ p.s.i., and large wire sizes, coupled with tension and wire pressure. Moreover, torsional rotation of this cable in long lengths as in oil well logging, adds severe fracture and handling complications.

It will now be understood that cable must have adequate flexibility for work handling as in materials handling systems (see FIGS. 1*a*, *b*, and *c*). In axially symmetric constructions, individual wires are small enough for bending, but the number must be comparatively large to meet the system bending requirement. However this construction requirement creates large numbers of local internal stresses at wire cross points, arising from layer or helical contacts, whih are also severe between non-compliant steel wires. As a result, elastic and frictional resistance (FIG. 1) are high.

Further to fractures, relative movement between steel wires causes case hardening due to wire pressure and the wear process. The notching effect at cross points materially weakens steel wire, which in turn, causes case hardening, fatigue and fractures.

This lack of suitability of steel wire for use in cable should be understood as being very high even after many years of development, and in fact, the common practice of its use is also expensive. To summarize, it has high elastic and frictional resistance, and having low elastic compliance, requires a large number of wires to be sufficiently flexible wherein internal stresses, fatigue and wear are high regardless, and further requires a high D/d ratio to moderate severe bend stresses. Bend fatigue with resulting fractures is then characteristic of materials handling systems while being contributed to by high surface contact stress ($\sigma c$), wire pressure (p) and local internal stresses, all persistently causing damage while work is being performed, and costly in downtime, maintenance and replacement (FIG. 1).

Al and ti qualify as future, commonly used materials for structural wire and cable since a few non-frangible alloys have been produced from each metal, while each have high dynamic properties including hard spring as noted above, wherein al dynamic properties are superior to ti, whereas ti alloys have superior strength to weight ratios and other useful physical attributes. Of course, al has already become commonly used as electrical wire having a proven conductive capacity on the order of 60 to 64 percent that of copper. Neither copper nor steel qualify because of low dynamic properties wherein any non-frangible characteristic can not overcome stiffness, non-compliance and high tension peaks in performing work required by materials handling systems, wherein fracturing flaws are dominant.

Comparison of a frangible and a non-frangible ti base alloy, Ti—13V—11Cr—3Al and Ti—6Al—4V, respectively, is of interest in the presentation of a detailed description of the invention, hereinbelow, from the beginning to the final stage in which the complex, axially symmetric cable structure is tested for its "flaw-state"; no fractures occur in the "non-frangible" cable in carefully designed cycle testing, the cable test specimens persistently modeling "non-fracture" behavior in the presence of other minor flaws, but completely without wire fractures.

First Stage — Alloy test specimens in laboratory testing (a) Brittle-ductile transition.

Ti—13V—11Cr—3Al — does not transition from plane strain to plain stress and develops unstable fracture extension at elastic stress bends Ti—6Al—4V — transitions from plane strain to plain stress into a high energy region (b) Fracture extension resistance (R)

Ti—13V—11Cr—3Al has shown low energy capacity to resist fracture extension with unstable extension Ti—6Al—4V—Plots at a "high rise" point on the fracture resistance curve (developed from data bank) for ductile metals (c) Drop tear energy Ti—13V—11Cr—3Al is not suited to this test because of its brittle, unstable fracture characteristic Ti—6Al—4V in a rolled condition having elongation of 18% contains 3050 ft. lbs energy, the highest energy among the ti base non-frangible alloys Second Stage — wire testing at 0.030" wire size (a) Tensile test (ten (10) specimens)

Ti—13V-11Cr-3Al—248 KPSI

Ti—6Al-4V—199 KPSI (b) Torsional test (ten (10) specimens)

Ti—13V—11Cr—3Al—8 turns

Ti—6Al—4V—86 turns

Note:

(1) 86 turns is greater than 96 to 105 turns for 0.030" low carbon steel wire compared on a strength to weight ratio basis (2) Fracture-toughness is generally known to be inversely proportional to tensile strength Third stage — Low and high stress regions A. Cycle testing in the lower stress region to determine "flaw state" of ¼ aircraft control cable for Ti-13V-11Cr-3A1, Ti-6A1-4V and corrosion resistant steel. A D/d ratio of 32 was used. In addition to 150 lb tension, a normal load for aircraft control cable, this tension provided a long period of cycling to test all physical flaws of the complex structure; this long period provided for accumulation of bend ($\sigma b$) and impact stresses ($\sigma i$) together with a low level of surface contact stress ($\sigma c$) in pulley grooves. Two (2) cable constructions 7×7 and 7×19 were used. Steel a/c primary control cable is not normally used in the 7×7 construction greater than a diameter of 3/32" because of low elasticity and high stiffness.

(a) Ti-13V-11Cr-3Al

¼ 7×19 cable — At 850,000 cycles numerous wire fractures had developed, these starting at 750,000. These fractures occurred in bending regions and at regions near the end terminals close to the two points of impact, in about equal numbers, showing each of these low order stresses eventually in this lengthy test had caused local fractures in this brittle alloy. However wire wear was very minor showing high abrasion resistance, this not being a factor in the fractures. At the conclusion, fractures were rapidly increasing.

(b) Ti-6A1-4V

First test — ¼" 7×19 cable was showing excellent results when the machine failed at 970,000 cycles. No wire fractures had occurred and wire wear was again, in the longer test period, inconsequential on all 133 wires.

Second test — ¼" 7×7 improved cable (49 larger wires) coated with solid film lubricant, was continued for 1.5 million cycles (3M reversals) without any wire fractures showing that the accumulation of characteristic stresses, as induced at bend and impact points had little effect. Wire wear again was unmeasurable but wire crowns were bright showing the solid film lubricant had been worn through.

Third test is a load deflection test of two (2) specimens of this improved ¼" 7×7, thin solid film coated, ti cable. Load deflection diagrams were made as shown in FIG. 4(*a*) and (*b*). It should be noted these diagrams are remarkably identical in load ($\sigma$) and strain ($\epsilon$), except three (3) strands remained unfractured in one, FIG. 4*a*, whereas 4 strands remained unbroken in FIG. 4*b*, it being surprising that all strands were not catastrophically fractured, as occurs in tests of small diam steel cable. Also variability in properties had been reduced such as tensile and torsional strength, and ductility had been increased in the wire drawing process so that wire elongation exceeded fifteen (15) percent. In changing from ¼" 7×19 steel cable to ¼" 7×7 Ti-6Al -4V cable, efficiency $$\left(\frac{\text{cable breaking strength}}{\text{total wire breaking str.}}\right)$$

increased from 80% (CRS) to 92% (Ti-6Al-4V). Moreover, cable breaking strength of the first ¼" 7×19 Ti-6Al-4V cable, of five (5) highly variable specimens averaged 3750 lbs., compared to 5250 lbs for Ti-6Al-4V 7×7 cable, an increase of forty (40) percent, after variability in ductility, uniformity in diameter and hardness were materially reduced.

(c) Corrosion resistant steel ¼" 7×19 cable was in condition to fail catastrophically under 150 lbs tension at less than ½ million cycles and wire fractures began at 375,000 cycles. Wire crown abrasion was sufficiently severe to cause a few fractures as did bend and impact stresses, and wire casehardening. It was obvious impacts at each reversal were far more severe than the titanium impacts due to the higher noise level of the former.

These tests showed the:

(1) marked superiority of ti cable, especially the non-frangible Ti-6Al-4V (2) non-frangible wire prevented fractures (3) fewer cable wires are required when having compliant wire, low density and high dynamic properties (4) the effect of frangibility and other physical properties upon flaw states, and (5) the influence of design criteria in complex cable structures in the lower stress region.

B. Cycle test loading in the high stress region, ranged from one-fifth (1/5) to one-half (½) breaking strength of ¼" 7×19 cable assembled from non-frangible Ti-6Al-4V ductile wire having an average elongation of fifteen (15) percent. Cycle life was found to be a function mainly of two (2) factors, (1) loading and (2) lubrication. At 1/5 breaking strength (lubricated), cycle life was greatest at 430 K cycles, and quite low at ½ breaking strength, (lubricated), cycle life being 10 K cycles. Cycle life was about one-seventh (1/7) with no lubrication compared to lubrication at the same loading (1/5). Wire wear was greatest on inner wires, especially the core strand. This wear proved to be about ten (10) percent at 1/5 loading, and as much as 40–50 percent at ⅓ loading. Wire fractures found, in a total of eight (8) specimens, to be greatest in cores due to a combination of wear, wire pressure & dynamic stress. Very few outer strand wires fractured and none fractured due to abrasion in pulley grooves. It should now be noted that liquid lubrication was used, while effective, was not as effective internally where the fractures and greater wear occurred due to being squeezed out under wire pressure. Solid film lubrication was concluded to be much more effective, when later used, and equally effective in the cable crosssection.

These conclusions were reached concerning flaw state and fail-safe design:

(a) The crucial flaw of wire fracture was prevented at one-fifth (1/5) load through a long period of work performance and would be substantially extended by solid film lubrication to neutralize or reduce wear (b) Enlarged core designs would reduce severe core strand wear (c) All wire fractures were accompanied by a marked reduction in tensile strength due to wear which then caused wire overloading at high stress levels, clearly noted in the specimens loaded at one-third and one-half breaking strengths (d) Greater latitude in applying design criteria improves the fail-safe design, and prevents and defers wire fractures in non-frangible wire (e) In the high stress region, the combination of (1) unsatisfactory lubrication, (2) high primary load (3) high dynamic stresses and (4) wire wear caused wire fractures, at ½ breaking strength load, wherein wear and variability in wire cross sections reduced tensile strength (f) Neither wire case hardening nor strain-hardening caused wire fractures as occurs in steel wire.

It will now be understood a process has been developed for changing the cable flaw state by analysis of the model behavior of test specimens in the three testing stages from metal specimens to complex cable structures, which advances cable technology as follows:

(a) fail-safe cable structures may be designed (b) wire fractures as a crucial flaw may now be eliminated (c) other flaws such as wear, abrasion, and fatigue may be moderated by assessing interactions and advanced cable designs may now be developed (d) changing design criteria so as to embody wider criterion latitude and improved trade-offs in making fail-safe designs Synthesis of the four (4) factors, herein described, provides for eliminating wire fractures and the embodiment of superior performance and service characteristics.

Non-frangible al alloys, in the same qualifying manner as outlined for testing ti base alloys through three (3) test stages, are suitable for work performing cable in both axially symmetric and contrahelical constructions. It should be observed that al conductor wire has reached a sophisticated and widely accepted state of development, again suitable for replacing copper conductor wire on a lower cost basis and at a lower level of effectiveness, about 60–64%.

Structural al wire, however, is of a different character wherein superior dynamic properties including medium hard spring may be exploited, as a trade off, against the outstanding high strength to weight ratio of ti base alloys.

As a further al attribute, electromechanical cable may be constructed to have homogeneous armor and electrical core characteristics, including dynamic properties, wherein the mechanical compliance characteristics for stored energy would be in concert with the metallurgical relative ductile characteristics for absorbing energy to determine how the structure will respond to loading in the presence of flaws. Medium hard wire spring would be reasonably effective in dissipating energy, and by wide amplitude stress vibration, stress propagation and distribution in compliant al cables would compare with this same force characteristic in titanium cable. The entire complex cross section would function as a tension member structural unit, wherein the essence of fail-safe design is the assessment of these two (2) interactions.

Al is our most versatile metal being easily and most economically susceptible to all commonly used fabrication processes and techniques, including coating for protection. Al wire has been assembled into structural cable for static, rigid applications. As noted al also has many attributes as does ti. The greatest structural divergence has generally been, within the complete range of alloys of both metals, is the lower strength-to-weight ratio, together with lower tensile strength of al base metal. However the range in al alloy tensile strength is wide, there being several accepted alloys just under 100,000 p.s.i.

Alloying practice is gradually increasing al tensile strength so that it may be expected state of the art development should bring tensile strength to become considerably greater than at present within two (2) to five (5) years in view of very wide commercial usage. Principal elements alloyed with al are:

Copper for improving properties in heat treated conditions

Manganese for general purposes and improving metal working

Silicon lowers the melting point without increasing brittleness so that it is used in welding wire Magnesium produces high strength Zinc produces high strength, heat treatable alloys In the several categories of alloys it is commonly found that at least one alloy will have high tensile strength, low gap between yield and ultimate strengths, high elongation and some will have high hardness, while all embody superior dynamic properties. Within this large number of alloys, a few are non-frangible.

It should be clear that, for both ti and al base alloys, the superior non-frangible alloy should be selected for cable constructions in order to produce the maximum effect upon cable flaw-state and fail-safe cable design. It was demonstrated in the cable model test (1) for load in the high stress region, that wire fractures were prevented until wire wear conditions reached a critical point that loading plus dynamic stress exceeded breaking strength, and (2), for load in the low stress region wherein no flaws developed, especially including fractures and wear so that appreciable strength was not lost although wire crown abrasion had started. This third stage testing also showed that a (1) fewer number of wires could be used to reduce wear and internal stresses, and (2) cable efficiency was increased (FIG. 4). Thus the "flaw state" of ¼" axially symmetric cable has been changed and improved, in performing work, by use of non-frangible wire having high dynamic properties. At the same time "fail-safe" design has been improved and advanced.

The crucial flaw, wire fractures in cable structures (as well as overstressing components) has been overcome and prevented by the novel synthesis of four (4) basic factors, as outlined, wherein cable "flaw-state" is now reduced to minor flaws which have also been moderated in the invention.

It has now been disclosed that non-frangible wire, together with high dynamic properties of al and ti base alloys, when assembled into cable improves the "flaw state" and "fail safe" design of work performing cable, and eliminates wire fractures as the "crucial flaw" of this cable during its service life. Wire fractures will not occur in the lower stress region, nor even in the higher stress region until cable breaking strength has been reduced at least by twenty-five (25) percent of its nominal rating, wherein the weakness caused by mild wear dominates the "flaw state."

These novel test findings upset the high tensile strength approach with high factors of safety of massive steel cable constructions in the old manner, wherein very redundant breaking strength, accompanied by stiffness, wire fractures and dynamic overstressing create early crucial flaws which undermine the fail-safe tension system design. The dominance of high tensile strength has also been upset in that it is shown to be relatively ineffective in classical dynamic states of tension systems for performing work.

The invention and its attendant advantages will be understood from the foregoing description and it will be apparent that various changes may be made in the form, construction and arrangement of the parts of the invention without departing from the spirit and scope thereof and without sacrificing its material advantages, the arrangement hereinbefore described being by way of example; and I do not wish to be restricted to the specific form described, or uses mentioned, except as defined in the accompanying claims, wherein various portions have been separated for clarity of reading and not for emphasis.

What is claimed is:

1. A non-ferrous wire comprising a ductile homogeneous body and a micro-flawed surface, having a non-strainhardening microstructure and a non-case hardening surface in condition for: (1) surface micro-smoothing by wide amplitude stress vibration impacts, and (2) deformation into short lay length helices, and having high dynamic tear test energy between 800 and 3700 ft.-lbs., an elastic modulus ($E_w$) between 8 and $17\times10^6$psi, and a spring constant inversely proportional to said modulus, and/wherein said wires have versatile strength including:

torsional strength between 25 and 90 torsions at densities between 0.075 and 0.175 lbs. per cu. in.

linear loading to not less than 90% of breaking strength strength-to-weight ratio between 8 and $12\times10^5$ impact fatigue strength of $10\times10^6$ cycles between 25,000 and 75,000 psi, whereby cables assembled from said wire do not develop physical flaws and have uniquely high work capacity.

2. A non-ferrous wire as in claim 1, said wire having a ti-base microstructure and dynamic tear test energy between 1200 and 3700 ft.-lbs. wherein said wire has:

high dynamic properties including a modulus of elasticity ($E_w$), between 14 and $17\times10^6$ psi, and a spring constant inversely proportional to said modulus with equal springback, and high versatile strength including: high torsional strength between 70 and 90 torsions at a density between 0.15 and 0.175 lbs per cu. in., high linear strength of not less than 90% of breaking strength, and high fatigue impact strength at $10\times10^6$ cycles at about 70,000 psi.

3. A non-ferrous wire as in claim 1, said wire having al al-base microstructure and dynamic tear test energy between 800 and 2,000 ft.-lbs. wherein said wire has:

high dynamic properties including a modulus of elasticity ($E_w$) between 7.5 and $10\times10^6$psi and a spring constant inversely proportional to said modulus with equal springback, and high versatile strength including high strength-to-weight ratio between 8 and $10\times10^5$, linear loading of not less than 92% of breaking strength, torsional strength between 25 and 60 torsions at a density between 0.075 and 0.175 lbs per cu. in., and high fatigue impact strength at $10\times10^6$ cycles between 25,000 and 50,000 psi.

4. A non-ferrous wire as in claim 1, wherein said wire is conditioned for deformation into structural shapes including springs, helices and rivets.

5. A non-ferrous wire as in claim 1, said wire having a ti-base microstructure and dynamic tear test energy between 1800 and 3700 ft.-lbs. wherein said microstructure is resistant to fracture extension and crack propagation until reaching $10\times10^6$ cycles at 70,000 psi, and approximately double this number at 45,000 psi.

6. A non-ferrous wire for use in energy conversion, comprising a wire body having a homogeneous, ductile microstructure and a micro-flawed surface, wherein said body is non-strainhardening and said surface is non-casehardening, and having dynamic tear test energy between 1200 and 3700 ft.-lbs., is in condition for: (1) surface micro-smoothing, and (2) deformation into helices having an elastic modulus ($E_w$) between 8 and $17\times10^6$ psi with a spring constant inversely proportional to said modulus, and wherein said wire has versatile strength including:

torsional strength of 25 to 90 torsions at a density between 0.075 and 0.175 lbs. per cu. in.

lineal strength of not less than 90% strength-to-weight ratio between 8 and $12\times10^5$, and fatigue impact strength at $10\times10^6$ cycles of 25,000 to 75,000 psi, whereby the microstructure of said wire is undisturbed by loading and stress vibration during energy interchange.

7. A non-ferrous wire as in claim 6, said wire having a ti-base microstructure, dynamic tear test energy between 1,200 and 3,700 ft.-lbs., and being micro-smoothed on the surface, wherein the mechanical force system of said wire characteristically propagates stress waves and stress rapidly through said system to: (1) minimize stored energy available for fracture propagation, (2) ductility of said system provides absorption capacity to resist fracture initiation and extension, and (3) said elasticity and spring constant dissipates said stresses, and whereby energy characteristics act in concert.

8. A cable made of a plurality of non-ferrous wires, stranded and layered in helices having short lay lengths of not less than ½" as a function of wire and cable diameters and a high preform angle not in excess of 30°, wherein cable modulus of elasticity ($E_c$) is between 6 and $12\times10^6$ psi and cable spring constant is inversely proportional to said modulus at a D/d ratio between 8 and 36, said elastic-spring relationship provides a counterbalancing characteristic to buffer axial impacts, wherein said wires:

are non-strainhardening and non-casehardening, and surfaces are in condition for micro-smoothing by wide amplitude stress vibration have homogeneous microstructures have high dynamic tear test energy between 1200 and 3700 ft.-lbs. to resist fracture initiation and extension, and crack propagation growth, and wherein said cable:

is fail safe at loadings not in excess of 30% of breaking strength and at safety factors of four (4) for materials handling and not in excess of eight (8) for personnel handling.

9. A cable for use in energy conversion made of a plurality of non-ferrous wires having a mechanical force system with energy conversion characteristics that operate in concert including:

relative compliance having a cable modulus of elasticity ($E_c$) between 6 and $14\times10^6$ psi and a spring constant inversely proportional to said modulus at a D/d ratio between 8 and 36 so as to limit the stored energy available for fracture propagation relative ductility having wire elongation in excess of 8%, short lay lengths and high preform not in excess of thirty (30°), and constructional stretch in excess of ½% to provide energy absorption capacity to resist fracture initiation and extension relative spring in concert with aid elasticity to dissipate energy having an axial counterbalancing and a wide amplitude stress vibration characteristic, and separable wires, and wherein said wires:

are non-strainhardening and non-casehardening on the surface have versatile strength including high torsional strength between 25 and 90 torsions at densities between 0.075 and 0.175 lbs. per cu. in., high linear strength in excess of 90% of breaking strength, high strength-to-weight ratio between 8 and $12\times10^5$, and impact fatigue strength at $10\times10^6$ cycles between 25,000 and 75,000 psi, whereby strain and kinetic energy durin energy interchange is absorbed, stored and dissipated rapidly and contiuously while performing work on a protracted basis.

10. A cable for use in energy conversion as in claim 9, in severe environmental conditions including sour gas, said wire having a homogeneous, ductile ti base microstructure wherein dynamic tear test energy is between 1800 and 3700 ft.-lbs., torsional strength is between 60 and 90 torsions at a density between 0.15 and 0.175 lbs per cu. in. wherein said elastic-spring relationship provides exceptional energy dissipation by means of constructional stretch in excess of ½% and high preform not in excess of 30°.

* * * * *